United States Patent [19]

Allen

[11] Patent Number: 5,000,343

[45] Date of Patent: Mar. 19, 1991

[54] COMBINATION CRACKER DISPENSER AND ENTERTAINMENT CENTER

[76] Inventor: Sharon M. Allen, 8 Neptune Rd., Rocky Point, N.Y. 11778

[21] Appl. No.: 401,933

[22] Filed: Sep. 1, 1989

[51] Int. Cl.[5] ..... G07F 11/54

[52] U.S. Cl. ..... 221/82; 221/89; 221/98; 221/121; 221/155; 221/194; 221/199; 222/192

[58] Field of Search ..... 220/22; 221/24, 69, 221/79, 80, 81, 82, 83, 97, 98, 155, 194, 89, 121, 199; 222/78, 144, 184, 192

[56] References Cited

U.S. PATENT DOCUMENTS

| | | | |
|---|---|---|---|
| 1,386,221 | 8/1921 | Bache | 222/184 |
| 2,553,880 | 11/1947 | Stigler | 220/22 X |
| 4,142,649 | 3/1979 | Forgey | 221/82 |
| 4,621,746 | 11/1986 | Reichle et al. | 221/83 X |
| 4,913,318 | 4/1990 | Forrester | 222/146.1 X |

*Primary Examiner*—H. Grant Skaggs
*Assistant Examiner*—Dean A. Reichard
*Attorney, Agent, or Firm*—Richard L. Miller

[57] ABSTRACT

A combination cracker dispenser and entertainment center is provided and consists of a housing that will contain a lazy susan tray near the bottom to hold crackers, a mechanism to dispense one cracker at a time, a dish near the top to hold dip therein to be used for the crackers and a built-in radio placed within a transparent middle portion of the housing.

4 Claims, 1 Drawing Sheet

FIG. 1
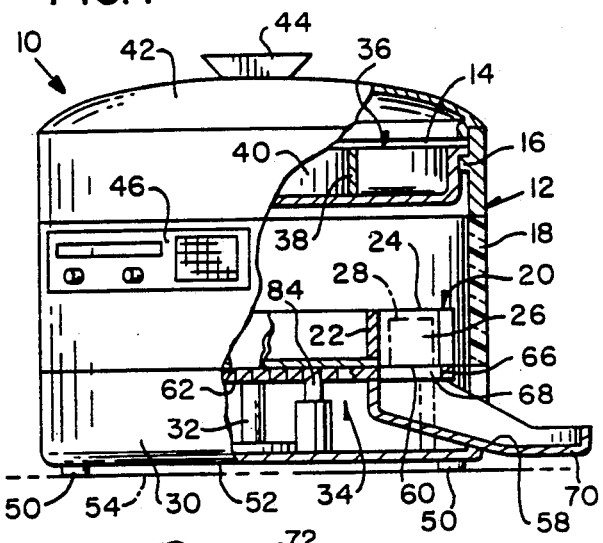
FIG. 3
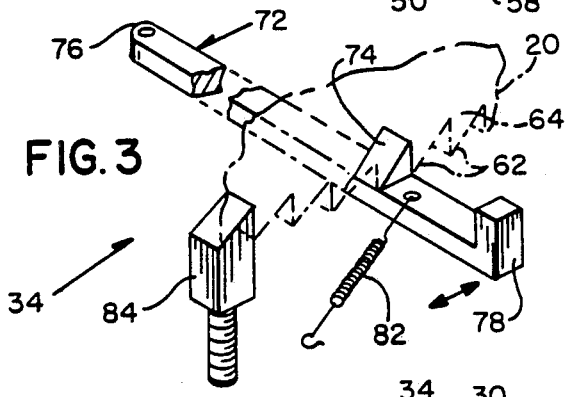
FIG. 4
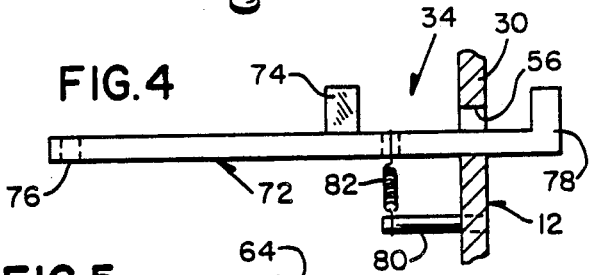
FIG. 5
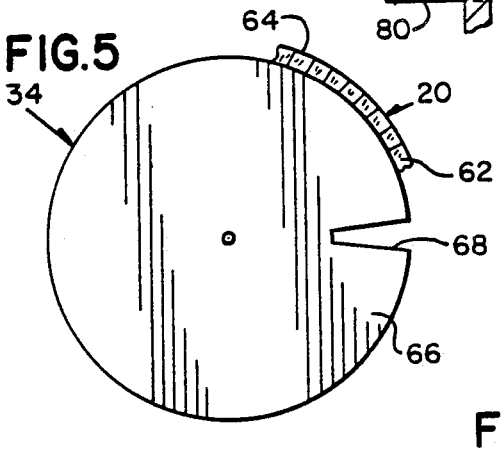
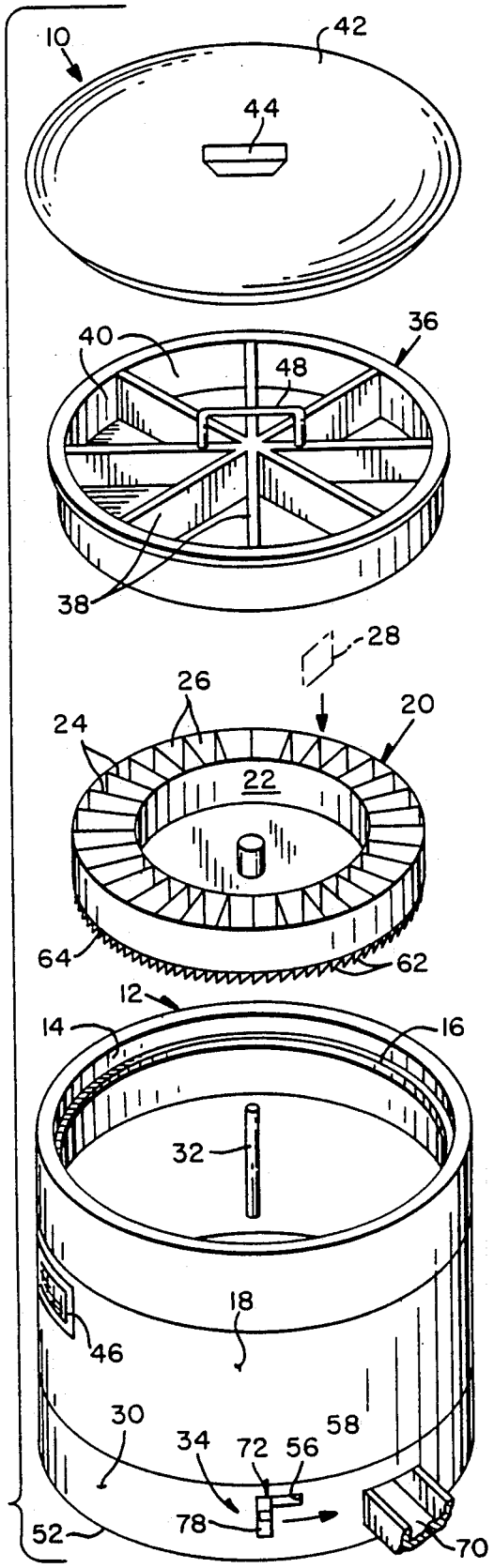
FIG. 2

COMBINATION CRACKER DISPENSER AND ENTERTAINMENT CENTER

BACKGROUND OF THE INVENTION

The instant invention relates generally to serving trays devices and more specifically it relates to a combination cracker dispenser and entertainment center.

Numerous serving trays devices have been provided in the prior art that are adapted to display and carry various foods therein so as to be readily accessible for people to get to and eat. While these units may be suitable for the particular purpose to which they address, they would not be as suitable for the purpose of the present invention as hereafter described.

SUMMARY OF THE INVENTION

A primary object of the present invention is to provide a combination cracker dispenser and entertainment center that will overcome the shortcomings of the prior art devices.

Another object is to provide a combination cracker dispenser and entertainment center that will contain a lazy susan tray to hold crackers, a mechanism to dispense one cracker at a time and a dish to hold a dip therein to be used for the crackers.

An additional object is to provide a combination cracker dispenser and entertainment center that will contain a built-in radio placed within a transparent portion of its housing.

A further object is to provide a combination cracker dispenser and entertainment center that is simple and easy to use.

A still further object is to provide combination cracker dispenser and entertainment center that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a diagrammatic fragmentary side view of the present invention, shown partly in section;

FIG. 2 is a partially exploded diagrammatic perspective view of FIG. 1 with portions broken away;

FIG. 3 is an enlarged and diagrammatic perspective view of the dispenser operating lever mechanism, shown engaged with the cracker receiving member that fragmentarily illustrated in phantom;

FIG. 4 is a diagrammatic side view illustrating the operating lever mounting in the wall of the invention, the wall being shown fragmentarily, in elevation and in section; and FIG. 5 is a top plan view of the bottom plate of the cracker dispenser, shown removed from the invention.

DETAILED DESCRIPTION OF THE PREFERRED EMBODIMENTS

Turning now descriptively to the drawings, in which like reference characters denote like elements throughout the several views, Figures illustrate a combination cracker dispenser and entertainment center 10 that contains a cylindrical housing 12 that has an open top 14, an annular inner flange 16 located near the open top 14 and a centrally located transparent portion 18. A lazy susan tray 20 has an annular segment 22 with a plurality of radially disposed partitions 24 forming a plurality of compartments 26 therein for holding a cracker 28 in each of the compartments 26. The tray 20 is rotatively carried within the housing 12 near lower portion 30 thereof on a shaft 32. A mechanism 34 is provided within the housing 12 for dispensing one cracker 28 at a time from each of the compartments 26 of the lazy susan tray 20.

A recessed dish 36 has a plurality of radially disposed partitions 38 forming a plurality of compartments 40 therein for holding dip to be used in conjunction with the crackers 28. The dish 36 is carried on the top inner flange 16 of the housing 12. A top cover 42 has a knob 44 thereon. The top cover 42 is gripped by the knob 44 so as to be placed over the recessed dish 36 in the open top 14 of the housing 12. A radio 46 is also built into the transparent portion 18 of the housing 12.

The dish 36 includes a centrally located handle 48 so that the dish 36 can be easily inserted and removed from the housing 12. The housing 12 includes a plurality of feet 50 carried on the bottom surface 52 thereof to stabilize the housing 12 when placed upon a flat surface 54.

The dispensing mechanism 34 includes the housing 12 having a horizontal slot 56 and an aperture 58 spaced away from the slot 56 in the lower portion 30 thereof. The lazy susan tray 20 has an open bottom 60 below the annular segment 22 and a plurality of teeth 62 disposed about the bottom, circumference 64 thereof. A stationary circular plate 66 has a notched out area 68 extending inwardly from one side thereof. The plate 66 is disposed directly below the lazy susan tray 20 within the circumference teeth 62 thereof.

A chute 70 extends from the notched out area 68 of the plate through the aperture 58 in the lower portion 30 of the housing 12. A lever 72 has an upper drive tooth, 74 thereon. The lever 72 is pivotally mounted at one end 76 within the housing 12 below the ratchet teeth 62 of the lazy susan tray 20 with the other end 78 extending through the slot 56. The upper drive tooth 74 will only engage with one of the ratchet teeth 62 on the lazy susan tray 20 when the lever 72 is raised and moved in one direction within the slot 56 to turn, the lazy susan tray 20 thus allowing a cracker 28 to fall through the notched out area 68 of the plate 66 and travel down the chute 70.

A pin 80 is carried on the inner surface of the lower portion 30 below the lever 72. A spring 82 extends between the pin 80 and the lever 72 to return the lever 72 back in an opposite direction to its original position. A spring biased pawl 84 is mounted below the lazy susan tray 20 to engage with ratchet teeth 62 to prevent the lazy susan tray 20 from moving back in the opposite direction with the lever 72.

To use the cracker dispenser and entertainment center 10 a person simply loads the lazy susan tray 20 with crackers 28 and the dish 36 with dip and places them within the housing 12. The cover 42 is then placed over the open top 14 and the lever 72 is moved to release a cracker 28 down into the chute 70. The cover 42 is removed so that the dip can be used. If so desired the radio 46 can be turned on to be listened to.

If also desired the dip dish 36 can be removed and set outside next to the entertainment center so the cover does not need to be removed each time a cracker is to be dipped.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. Combination cracker dispenser and entertainment center which comprises:

(a) a cylindrical housing having an open top, an annular inner flange located near the open top and a centrally located transparent portion;

(b) a lazy susan tray having an annular segment with a plurality of radially disposed partitions forming a plurality of compartments therein for holding a cracker in each of the compartments, said tray rotatively carried within said housing near a lower portion thereof;

(c) means within said housing for dispensing one cracker at a time from each of the compartments of said lazy susan tray and comprising: a horizontal slot formed in said housing and an aperture spaced away from said slot formed in said lower portion of said housing;

an open bottom in said lazy susan tray below the annular segment and a plurality of ratchet teeth disposed about a bottom circumference edge thereof;

a stationary circular plate having a notched out area extending inwardly from one side thereof, said plate disposed directly below said lazy susan tray within the circumference of said ratchet teeth thereof;

a chute extending from the notched out area of said plate through the aperture in said lower portion of said housing;

a lever having an upper drive tooth thereon, said lever being pivotally mounted at one end within said housing below the ratchet teeth of said lazy susan tray with the other end extending through the slot so that said upper drive tooth will only engage with one of the ratchet teeth on said lazy susan tray when said lever is moved in one direction within the slot toward the notched out area of said plate and to bring the next cracker holding compartment into alignment with said chute permitting the cracker held therein to travel down said chute;

a pin carried on the inner surface of said lower portion below said lever;

a spring extending between said pin and said lever to return said lever back in an opposite direction to its original position; and a spring biased pawl mounted below said lazy susan tray to engage with the teeth to prevent said lazy susan tray from moving backward in the opposite direction with said lever;

(d) a recessed dish having a plurality of radially disposed partitions forming a plurality of compartments therein for holding dip to be used in conjunction with the crackers, said dish carried on the top inner flange of said housing;

(e) a top cover having a knob thereon whereby said top cover may be gripped by the knob so as to be placed over said recessed dish in the open top of said housing; and (f) a radio built into the transparent portion of said housing.

2. Combination cracker dispenser and entertainment center as recited in claim 1, wherein said dish further includes a centrally located handle so that said dish can be easily inserted and removed from said housing.

3. Combination cracker dispenser and entertainment center as recited in claim 2, wherein said housing further includes a plurality of feet carried on bottom surface thereof to stabilize said housing when placed upon a flat surface.

4. A cracker dispenser comprising:

(a) a cylindrical housing having an open top, an annular inner flange located near the open top and a centraly located transparent portion;

(b) a lazy susan tray having an annular segment with a plurality of radially disposed partitions forming a plurality of compartments therein for holding a cracker in each of the compartments, said tray rotatively carried within said housing near a lower portion thereof;

(c) means within said housing for dispensing one cracker at a time from each of the compartments of said lazy susan tray and comprising: a horizontal slot formed in said housing and an aperture spaced away from said slot formed in said lower portion of said housing;

an open bottom in said lazy susan tray below the annular segment and a plurality of ratchet teeth disposed about a bottom circumference edge thereof;

a stationary circular plate having a notched out area extending inwardly from one side thereof, said plate disposed directly below said lazy susan tray within the circumference of said ratchet teeth thereof;

a chute extending from the notched out area of said plate through the aperture in said lower portion of said housing;

a lever having an upper drive tooth thereon, said lever being pivotally mounted at one end within said housing below the ratchet teeth on said lazy susan tray with the other end extending through the slot so that said drive tooth will only engage with one of the ratchet teeth on said lazy susan tray when said lever is moved in one direction within the slot toward the notched out area of said plate to bring the next cracker holding compartment into alignment with said chute permitting the cracker held therein to travel down said chute;

a pin carried on the inner surface of said lower portion below said lever;

a spring extending between said pin and said lever to return said lever back in an opposite direction to its original position; and a spring biased pawl mounted below said lazy susan tray to engage with the teeth to prevent said lazy susan tray from moving backward in the opposite direction with said lever;

(d) a recessed dish having a plurality of radially disposed partitions forming a plurality of compartments therein for holding dip to be used in conjunction with the crackers, said dish carried on the top inner flange of said housing;

(e) a top cover having a knob thereon whereby said top cover may be gripped by the knob so as to be placed over said recessed dish in the top of said housing.

* * * * *